US005402134A

United States Patent [19]

Miller et al.

[11] Patent Number: 5,402,134

[45] Date of Patent: Mar. 28, 1995

[54] FLAT PLATE ANTENNA MODULE

[75] Inventors: Paul E. Miller, Spring Lake, Mich.; Glen J. Seward, Fort Wayne, Ind.; Robert M. Lynas, Spring Lake, Mich.

[73] Assignee: R. A. Miller Industries, Inc., Grand Haven, Mich.

[21] Appl. No.: 22,663

[22] Filed: Mar. 1, 1993

[51] Int. Cl.[6] ..... H01Q 11/12

[52] U.S. Cl. ..... 343/742; 343/713; 343/867; 343/745

[58] Field of Search ..... 343/711, 712, 713, 742, 343/744, 866, 867, 797, 745; H01Q 1/32

[56] References Cited

U.S. PATENT DOCUMENTS

| | | | |
|---|---|---|---|
| 2,749,544 | 5/1953 | Pike | 343/742 |
| 2,787,788 | 4/1957 | Clough | 343/742 |
| 3,971,031 | 7/1976 | Burke | 343/744 |
| 4,012,742 | 3/1977 | Dempsey | 343/742 |
| 4,717,920 | 1/1988 | Ohe et al. | 343/713 |
| 4,721,963 | 1/1988 | Nagy et al. | 343/712 |
| 4,737,795 | 4/1988 | Nagy et al. | 343/712 |
| 4,758,166 | 7/1988 | Bonnett et al. | 343/712 |
| 4,769,655 | 9/1988 | Nagy et al. | 343/712 |
| 4,785,303 | 11/1988 | Clark et al. | 343/742 |
| 4,821,040 | 4/1989 | Johnson et al. | 343/700 MS |
| 4,866,453 | 9/1989 | Nagy et al. | 343/712 |
| 4,873,530 | 10/1989 | Takeuchi et al. | 343/711 |
| 5,049,892 | 9/1991 | Lindenmeier et al. | 343/713 |
| 5,079,560 | 1/1992 | Sakurai et al. | 343/713 |
| 5,124,714 | 6/1992 | Harada | 343/713 |
| 5,142,292 | 8/1992 | Chang | 343/742 |
| 5,198,826 | 3/1993 | Ito | 343/726 |

FOREIGN PATENT DOCUMENTS

| | | | |
|---|---|---|---|
| 2166000 | 4/1986 | United Kingdom | 343/742 |

OTHER PUBLICATIONS

H. Jasik, Antenna Engineering Handbook, McGraw-Hill, pp. 6-1 through 6-3.

The ARRL Antenna Handbook, 14th Edition, American Radio Relay League, pp. 2-27, 2-28.

*Primary Examiner*—Donald Hajec

*Assistant Examiner*—Tan Ho

*Attorney, Agent, or Firm*—Varnum, Riddering, Schmidt & Howlett

[57] ABSTRACT

An antenna module for use a non-conductive cab of a motor vehicle includes a dielectric substrate and one or more antenna loops arranged on the substrate. The substrate is adapted to be installed between the headliner of a cab and the dielectric roof. The module may include a CB antenna loop, an AM/FM antenna loop, a cellular mobile telephone antenna loop, and a global positioning system antenna, without the need for any antenna structure external to the cab. The antennae are arranged on the module in a nested configuration. A CB antenna, provided with loading coils, forms an outer loop. An AM/FM antenna loop, including a capacitor yielding a substantially short circuit connection in the FM frequency range, forms a FM frequency antenna loop and an AM frequency dipole, within the CB loop. A multiloop array cellular telephone antenna is arranged within the AM/FM loop. A standard crossed dipole GPS antenna is positioned in an area between the CB loop and the AM/FM loop near one corner of the substrate. Coaxial antenna feedlines connected to the various antennae are routed through cab support posts to associated electronic circuitry in the cab.

21 Claims, 4 Drawing Sheets

FLAT PLATE ANTENNA MODULE

BACKGROUND OF THE INVENTION

1. Field of the Invention

The invention relates to antenna modules for installation under dielectric covers and more particularly to antenna modules for use in motor vehicle cab structures made of dielectric material such as fiberglass.

2. Related Art

Presently motor vehicles such as cars, trucks, recreational vehicles and the like use several antennas for such purposes as cellular telephones, CB, global positioning system (GPS) as well as the standard AM/FM radio. Typically, a separate antenna mounted external to the body of the vehicle is provided for each such system. This proliferation of antennae is attended by special problems such as finding an appropriate mounting position for non-interfering operation as well as such inconveniences as high speed antennae noise or "whistle". Attempts have been made in the prior art to avoid the external antennas and incorporating antennas into window panes and roof panels and the like.

Non-conducting materials, e.g. , fiberglass, has been used for some time in the construction of cars and especially in the construction of truck cabs. The use of such a dielectric material presents a problem for antenna designers since most antennae require the ground plane provided by the metallic vehicle body for efficiency of operation.

One prior patent, U.S. Pat. No. 4,737,795 issued Apr. 12, 1988 describes an AM/FM antenna in the form of a slot antenna formed in a horizontal sheet of conducting material and installed under a non-conductive roof portion inserted in a metallic vehicle roof. Such slot antennas are relatively expensive and for optimum reception preferably employ separate feed lines for AM and FM, adding further to the expense of the antenna installation. While the use of such antenna has been proposed for CB and cellular telephone, it is not clear that such a slot antenna will work effectively for those purposes, In another known arrangement, described in U.S. Pat. No. 4,821,040 issued Apr. 11, 1989, a circularly shaped slot antenna spaced above a conductive reference surface, is mounted under the plastic roof of a vehicle for operation in the mobile radio frequency range. An annular resonant cavity is defined between a disk and a conductive reference surface. The disk is supported on a post which may be up to three-quarter inch in height providing an overall structure of significant thickness between the roof and the headliner of an automobile. The antenna consists of a number of parts which must be separately machined or die stamped or the like. Such an antenna will be relatively expensive to manufacture.

In another known arrangement, shown in U.S. Pat. No. 5,124,714 issued Jun. 23, 1992 a planar slot antenna is disclosed having an inner and outer conducting surface for AM/FM reception and a closed-circle slotted antenna formed in the inner conductive surface for use in the telephone frequency range. A particular disadvantage of that antenna is that the output from one slot antenna is interrupted when communications are received by the other slot antenna.

A significant problem of the industry is that no efficient and relatively inexpensive antenna arrangement is available for use with vehicle cab structure made of a dielectric material.

SUMMARY OF THE INVENTION

These and other problems of the prior art are overcome in accordance with this invention by means of one or more antenna formed from thin conductor strips on a single non-conductive planar substrate which readily fits between the headliner of a truck cab or the like and a non-conductive roof panel or similar structure. Advantageously, the antenna structure of this invention does not require a ground plane and is inexpensive to manufacture. The antenna may be formed on a standard substrate by known printed circuit fabrication techniques. The substrate is preferably flexible to be readily adapted to the contour of the space between the roof and headliner of a truck cab or the like.

In one embodiment of the invention, the antenna module comprises a substantially square mobile telephone antenna loop for the transmission and reception of mobile cellular telephone signals, formed from a plurality of conductor sections disposed on a substrate. The perimeter of the antenna loop has an electrical length approximately equal to two wavelengths of a signal in the cellular frequency range and is provided with conductor sections at each corner of the square forming four separate loading capacitors. The conductor sections forming the capacitors are adapted to be trimmed to optimize the antenna effectiveness under different operating conditions. It has been found that the electrical length of the loop for optimum operation of the antenna will vary depending on the position of the antenna relative to a dielectric cover and the mass and dielectric coefficient of the roof panel or the like near which the antenna is installed. Advantageously, the antenna may be customized and adapted to a particular vehicle by trimming the conductor strips forming the capacitors to selectively provide optimum operation of the antenna in the particular installation. Typically, the antenna will be adjusted by trimming of the capacitive strips for a particular type or model of a vehicle and all antennas used with that vehicle type or model are produced with the same dimensions.

In another embodiment of the invention, the antenna module includes a substantially square AM/FM antenna loop formed from conductor sections disposed on the substrate and surrounding the mobile telephone antenna loop. The AM/FM antenna loop comprises a pair of conductor sections of substantially equal length and a capacitor. Each conductor has one end connected to an antenna feed line and another end connected to one side of the capacitor. The capacitor has a predetermined value of capacitance such that the capacitor presents a substantially short circuit in the FM frequency range but not in the AM frequency range. Advantageously, this arrangement provides an FM antenna loop with an electrical length equivalent to one wavelength in the FM range and a modified dipole antenna in the AM range.

In another embodiment of the invention, the antenna module comprises a CB antenna loop surrounding the AM/FM antenna loop. The CB antenna is provided with a coil in each of the four sides forming the loop that extends the electrical length of the loop to a length equivalent to one wavelength in the CB range. The mobile antenna loop, the AM/FM antenna loop, and the CB antenna loop are individually connected to separate antenna feed lines and the AM/FM and CB feed lines are connected to their respective antenna loops near one corner of the substrate. All three of the antenna feed lines may be conducted through a roof support post to corresponding electronic equipment.

In a further embodiment of the invention, the antenna module includes a crossed dipole GPS antenna disposed in an area of the substrate in between a portion of the CB antenna loop and a portion of the AM/FM antenna loop. The GPS antenna is connected by an antenna feed line and conducted through a roof support column to the corresponding electronic equipment.

Advantageously the antenna module, in accordance with this invention, may be readily adapted to provide from one to four antennas on a single substrate and may be readily installed in a dielectric cab structure without the need to modify the cab structure and without the need to mount any part of any antenna external to the cab structure.

BRIEF DESCRIPTION OF THE DRAWING

An illustrative embodiment of the invention is described below with reference to the drawing and which.

DETAILED DESCRIPTION

Figure 1:
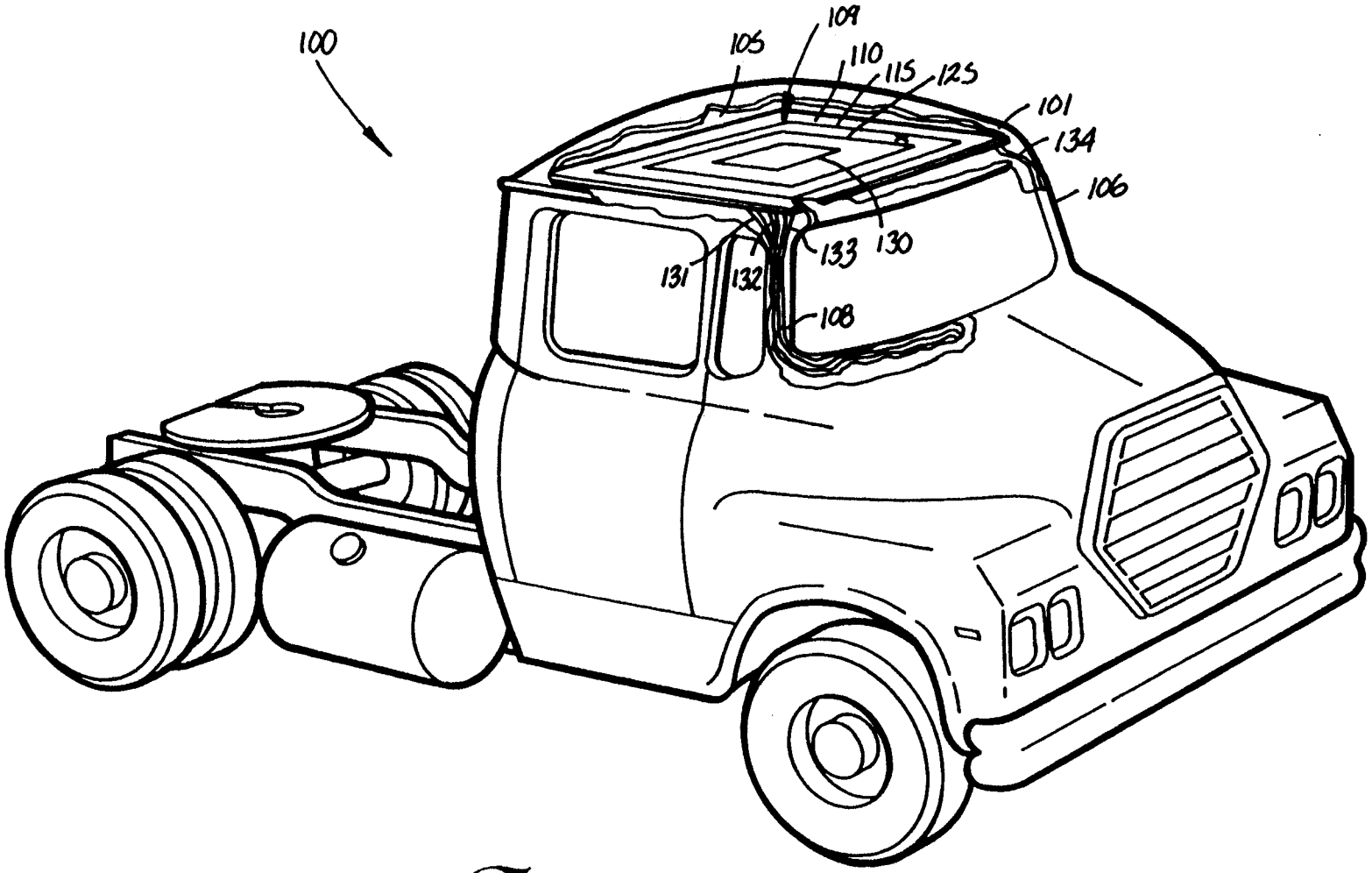
FIG. 1 is a perspective partial cut-away view of a vehicle having a multiple antenna module incorporating the principles of the invention installed between a dielectric roof and the headliner of the vehicle.

FIG. 1 is a perspective rendering of a truck cab 100 with a cut away section of the roof 101 and an antenna module 109 disposed between the roof 101 and the cab headliner 105. The antenna module includes several loops disposed on a substrate 110. The loops include a CB antenna loop 115, and AM/FM antenna loop 125 and a mobile telephone loop 130. Antenna feed lines 131 through 133, individually connected to the antenna loops 115, 125 and 130, respectively, are routed along a roof support post 108 to associated electronic equipment inside the cab. A global positioning system (GPS) antenna 134 is also incorporated in the substrate 110 and is connected via antenna feed line 134, routed along a roof support column 106, to associated electronic equipment inside the cab. The antenna feed lines are preferably kept short to avoid high frequency losses, particularly the GPS feed line 134 which receives signals of a frequency greater that 1,000 MHz.

Figure 2:
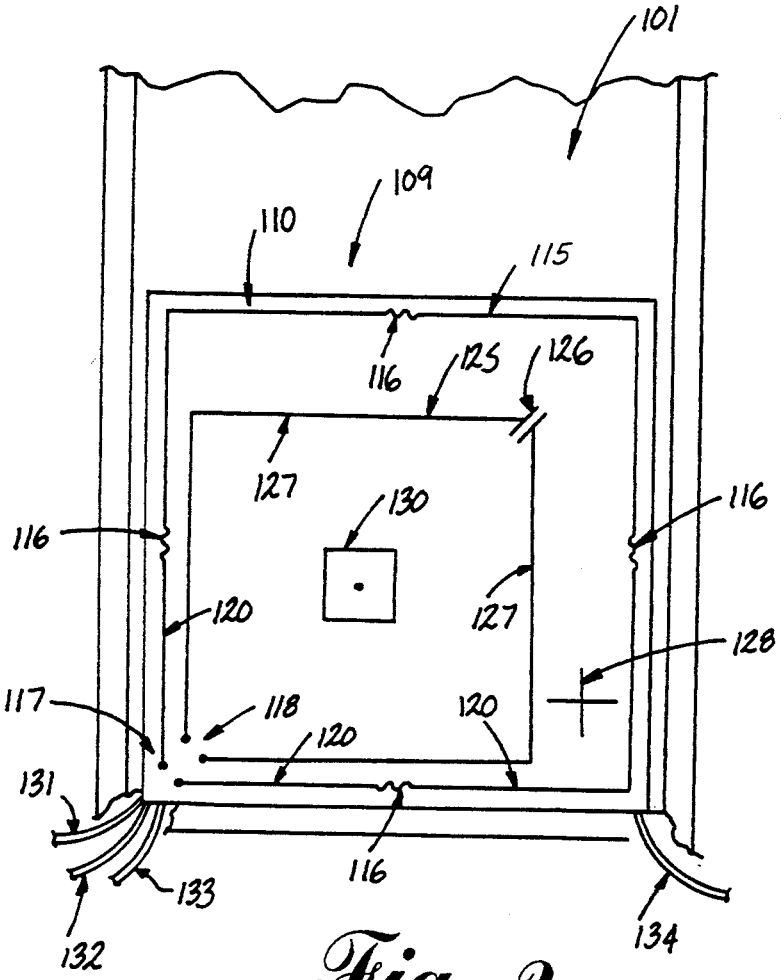
FIG. 2 is a partial cut-away view of the vehicle roof of FIG. 1 showing a plan view of the module.

FIG. 2 is a partial cut away view of the vehicle roof showing a plan view of the antenna module 109. The antenna includes a dielectric substrate 110 which may be made of any dielectric material which does not have high loss and is flexible or able to be formed to conform to the space between the underside of a vehicle roof and the headliner. A substrate of fiberglass or commercially available Kapton having a thickness in the range of 0.010 to 0.050 inches has been found to be suitable. The substrate is preferably approximately square and somewhat larger than the dimensions of the largest antenna loop, which is the CB antenna loop 115 in a typical cab installation. The substrate may be approximately 48 inches on each side. The CB loop 115 consists of five separate conductor strips 120 deposited on the substrate, together forming a substantially square loop. The CB loop terminates on connector points 117 which extend through substrate 110 and connect to electrical cable 131 on the underside of the substrate. Each side of the square CB antenna loop includes a loading coil 116 which serves to increase the electrical length of each side of the loop such that the total electrical length of the loop is approximately one wavelength in the CB frequency range (e.g. 27 MHz).

The AM/FM antenna loop 125 has two separate conductor sections 127 together forming a square loop having a total length of approximately one wavelength in the FM frequency range (e.g., 98 MHz). A capacitor 126 is connected between the two conductor sections 127 in one corner of the square loop 125. The two conductor sections 127 are each connected to one side of capacitor 126 and to connector points 118 in an opposite corner of the loop. The latter extends through substrate 110 and are connected to antenna feed line 132 on the underside of the substrate. The capacitor 126 may be a discreet capacitor mounted on the substrate and having a value of capacitance such that the capacitor presents essentially a short circuit connection at the FM frequency and has a substantial impedance in the AM frequency range. A capacitor in range of 50–100 picofarad has been found to perform adequately for these purposes. The use of the capacitor 126 provides a full wavelength FM antenna loop while providing the equivalent of two separate dipole antennae for AM reception.

Figure 5:
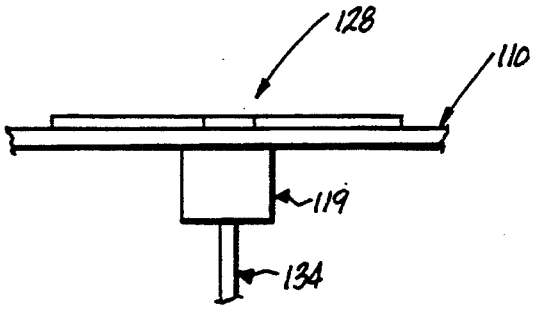
FIG. 5 is a partial cut away side view of the substrate showing the crossed dipole GPS antenna.
Figure 3:
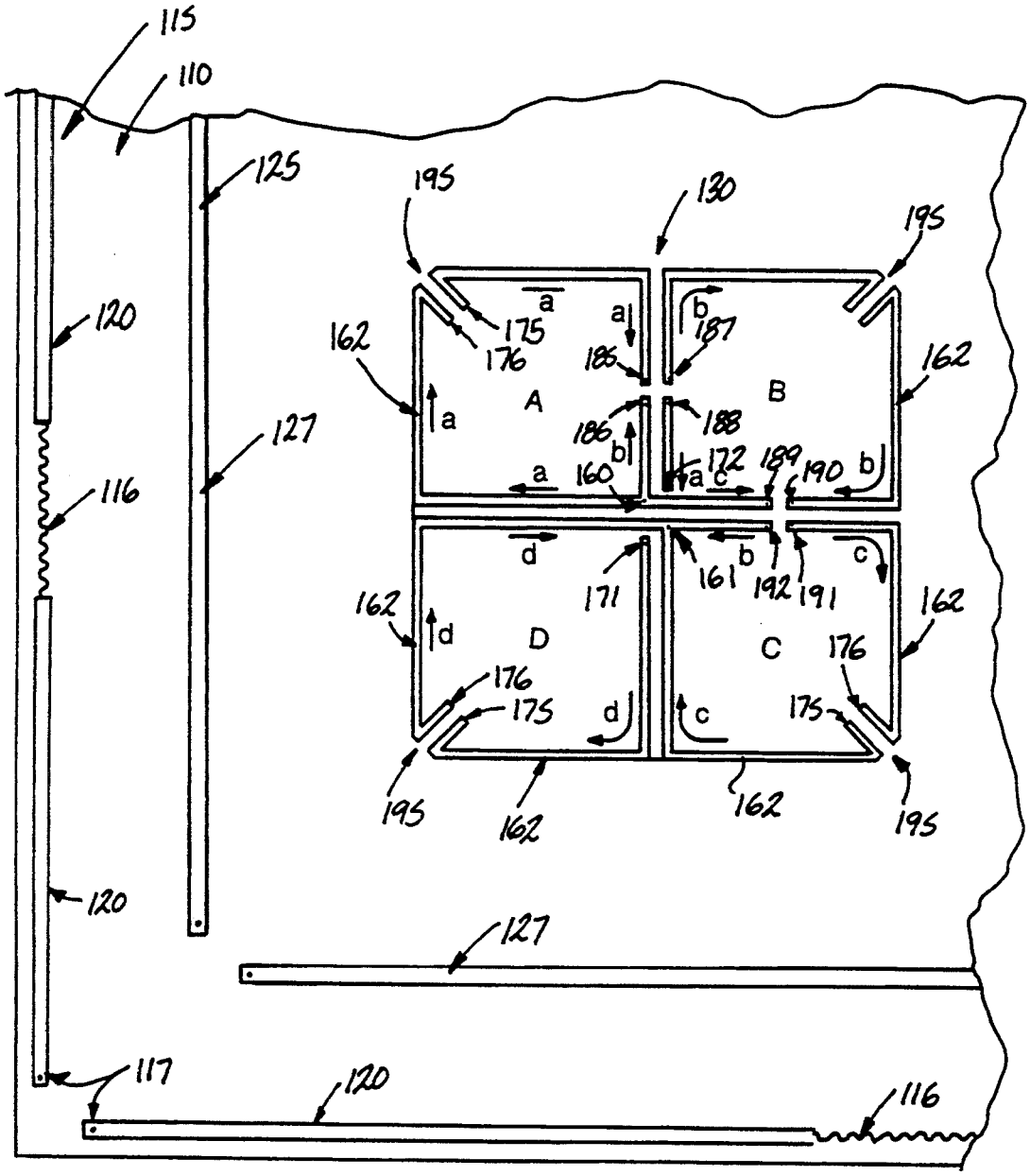
FIG. 3 is an enlarged plan view of a portion of the module showing conductors strips applied to a dielectric substrate to form multiple antennas.

A standard, commercially available, crossed dipole GPS antenna 128 may be incorporated in the substrate to receive geographical positioning information from the global positioning system. FIG. 5 is a side view a proportion of the substrate 110 showing the GPS antenna 128 which includes a housing portion 139 extending below the substrate 110 to which the antenna feed cable 134 is connected. The antenna feed cables 131 through 134 may be standard coaxial cables connecting the antennae to their associated electronic equipment inside the cab. The cellular antenna loop 130, which is shown in greater detail in FIG. 3, is positioned approximately at the center of the square formed by the AM/FM antenna loop 125 to minimize interference between the AM/FM antenna 125 and the cellular antenna 130. As shown in FIG. 2, the AM/FM antenna 125 is disposed within the square formed by the CB antenna 115 and toward one corner of the CB antenna 115. The offset arrangement allows space on the substrate 110 for the GPS antenna 128 near one corner of the substrate and allows the feed line connection for the AM/FM antenna to be disposed near one corner of the substrate 110.

Referring now to FIG. 3, the loading coils 116 in the CB loop 115 are shown as discrete, tightly wound coils. The inductance of these coils will vary to some extent for various installations, depending of the thickness and dielectric properties of the roof under which the antenna is installed. The exact number of turns of the coils 116 is selected as such that the electrical length of the CB loop is equivalent to one wavelength of the CB frequency range. The conductors 120 and 127 as well as conductors of the cellular antenna loop 130 are shown in FIG. 3 as conductor strips which have been deposited on the substrate. The conductor strips may be made of copper or the like conductive material and deposited on the substrate by means of standard printed circuit board fabrication techniques or may be discrete strips fastened to the substrate in a well-known manner. The width of the conductor strips may, for example, be on the order of 0.1 inches and the distance between adjacent strips may, for example, be at least 0.15 inches. The thickness of the strips does not appear to have any substantial effect on the efficiency of the antenna due to the skin effect. In copper conductors, in the one MHz or greater frequency range the depth of current penetration is theoretically less than 0.1 millimeter. Commonly, deposited conductor strips are substantially thicker than that.

As shown in FIG. 3, the cellular antenna loop 130 comprises a four loop array antenna. Four loop array antennas are known in the art and are used to obtain high gain. The electrical length of each side of each of the four loops of loop 130 is approximately equal to one-quarter wavelength for a frequency near the center of the cellular frequency range, e.g., 860 MHz. The perimeter of the loop 130 is therefore approximately equal to two wavelengths at that frequency. Four separate loop currents occur in the four loop array with a different current pattern for each of the loops A, B, C and D. The current flow is indicated by arrows and lower case letters corresponding to the loop designation. Coaxial cable 133 is connected from the underside of the substrate 110 to terminal points 160 and 161 which extend through the substrate. Crossovers are provided on the underside of the substrate 110 to make connection between connector points 185 and 188, between connector points 186 and 187, between connector points 189 and 191 and between connector points 190 and 192. Additionally, connections are made on the underside of the substrate 110 between connector points 160 and 171 and between connector points 161 and 172.

The cellular antenna array 130 is provided with parallel extending conductor strips 175, 176 at each of the four corners of the array which provide loading capacitance. The current flow in the four separate loop is such that a current flows from the antenna feed connecting point 160 and into antenna feed connecting point 161 through the conductor strips, the capacitive areas and the crossover connections on the underside of the substrate 110. Each of the individual loop A,B,C,D has two perimeter sections forming a part of the larger perimeter of loop 130. The current direction in each of the individual loops is such that perimeter currents in the perimeter sections of adjacent loops that form part of the larger perimeter of loop 130, flow in the same direction. By way of example, in loop A current flows from the connecting point 160 through a conductor strip 162 and capacitor area 195 to another conducting strip 162 and via connecting points 185, 188 and 172 to the antenna feed line connecting point 161. The arrows in the drawing show the current flow for loops B, C and D flowing from feed line connecting point 160 through various conductor strips 162, capacitive areas 195 and crossover connections to feed line connection point 161. In the manner shown in FIG. 3, a current is established in the clockwise direction in the antenna loop 130. The conductor strips 160, 175 and 176 may have a width in the range of 0.050 to 0.200 inches and may be separated by a distance of between 0.100 and 0.400 inches.

As stated earlier herein, the electrical length of each side of each of the loops of the cellular antenna loop 130 is approximately one-quarter wavelength of a frequency in the cellular frequency range. The electrical length of each loop has been found to be influenced substantially by the thickness of the dielectric roof as well as the dielectrical coefficient of the material from which the roof is constructed. In a typical roof construction having a thickness in the range of approximately 0.075 to 0.400 inches and having a dielectric coefficient in the range of approximately 2 to 5, a frequency shift of the antenna due to installation in the immediate proximities of a particular dielectric roof may be on the order of 5%. To compensate for that effect, the capacitor strips 175, 176 at each of the corners are made of a length sufficient to allow the strips to be trimmed, e.g., approximately one inch. The strips are trimmed to adjust the electrical length of the loops such that the electrical length of each of the individual loops is equivalent to one wavelength at a selected frequency in the cellular telephone frequency range when the antenna is positioned adjacent to a particular cover, such as a dielectric roof structure. In such a case, each side of each of the loops is approximately one-quarter wavelength in length and the spacing between opposite sides of the overall array is approximately one-half wavelength, thereby providing a high gain antenna structure. The cellular array may be readily customized for each different type or model of vehicle and subsequently produced antennas for the particular type or model may be readily mass-produced without the need for further adjustment.

Figure 4:
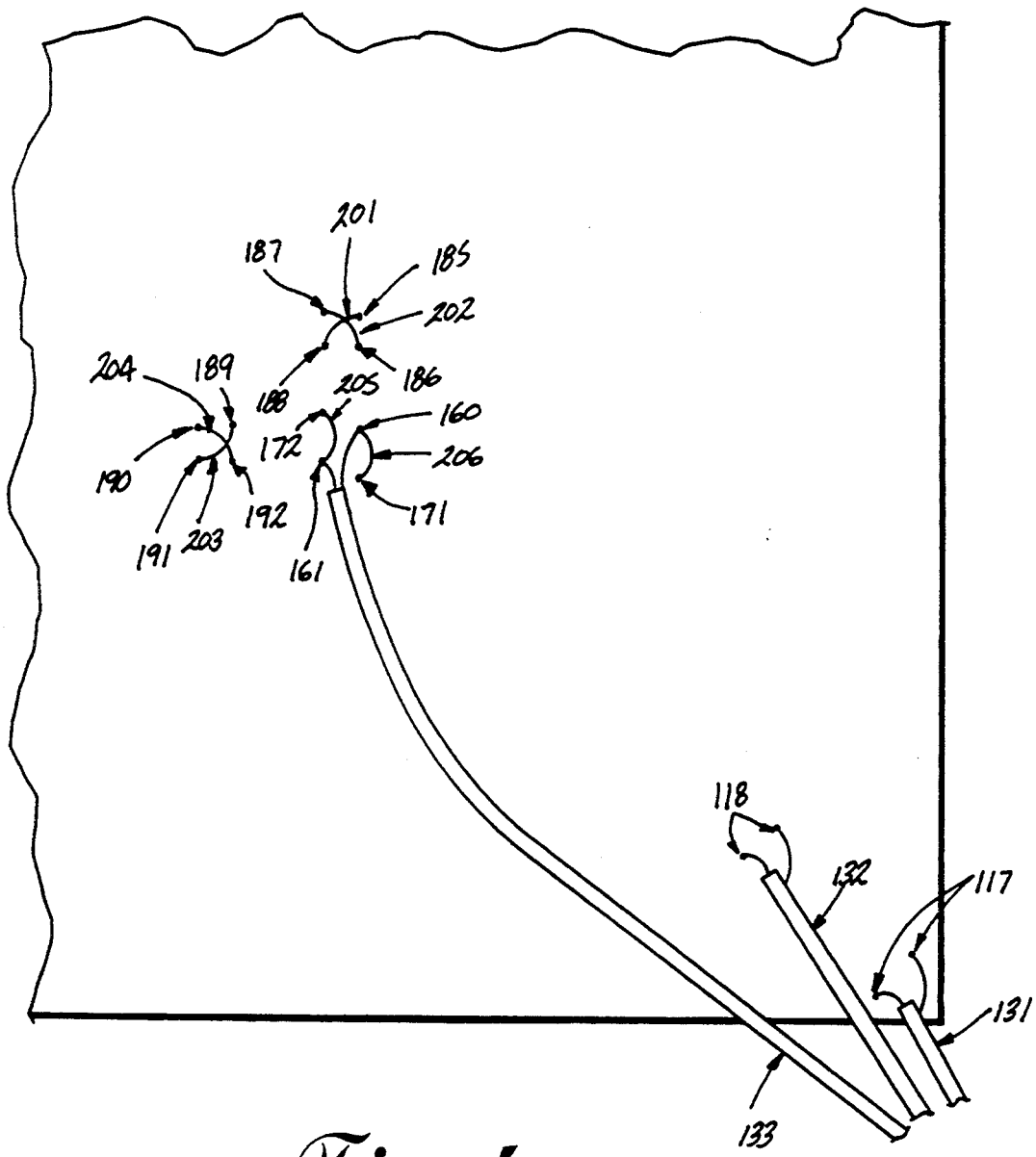
FIG. 4 is a bottom view of the portion of the substrate shown in FIG. 3.

FIG. 4 is a plan view of the underside of the portion of the substrate shown in FIG. 3 and shows the connections to the antenna feed cables 131 through 133. Shown as well are crossover connection 201 between connector points 185 and 188, crossover connection 202 between connector points 186 and 187, crossover connection 203 between connector points 189 and 191 and crossover 204 between connector points 190 and 192 shown in FIG. 3. Additionally, crossover connection 205 is shown in FIG. 4 extending between connecting points 161 and 172 and crossover connection 206 which extends between connecting point 160 and connecting point 171.

It will be understood that the embodiment described herein is only illustrative of the principles of the invention and that other embodiments may be devised by those skilled in the art without departing from the spirit and scope of the invention.

What we claim is:

1. A planar antenna module for installation under a dielectric cover of a vehicle, comprising:

a dielectric substrate;

a mobile telephone antenna loop for transmission and reception of mobile cellular telephone signals and comprising a plurality of conductor sections on the substrate forming a substantially square loop having a perimeter of an electrical length approximately equal to two wavelengths of a signal in the frequency range of cellular telephone signals, the conductor sections at each corner of the square loop forming four separate loading capacitors, the conductor sections forming the capacitors adapted to be shortened to optimize the antenna effectiveness when installed in the proximity of dielectric covers of differing dimensions and dielectric characteristics; and conductor sections disposed on the substrate forming a substantially square AM/FM antenna loop surrounding the mobile telephone antenna loop, the AM/FM antenna loop comprising a pair of conductor sections of substantially equal length and a capacitor, each conductor section having one end connected to an antenna feed line and another end connected to one side of the capacitor, the capacitor having a predetermined value of capacitance such that the capacitor presents a substantially short circuit at FM frequencies.

2. The antenna module in accordance with claim 1 and further comprising conductor sections disposed on the substrate forming a substantially square CB antenna loop surrounding the AM/FM antenna loop for transmission and reception in the CB frequency range, the CB antenna loop comprising a plurality of antenna coils connected between certain of the conductor sections of the CB loop to provide an effective electrical length of the CB loop equivalent to one wavelength in the CB frequency range.

3. The antenna module in accordance with claim 2 wherein the mobile telephone antenna loop is connected to a first antenna feed line and the AM/FM antenna loop is connected to a second antenna feed line and the CB antenna loop is connected to a third antenna feed line and wherein the second and third antenna feed lines are connected to the respective antenna loops near one portion of the substrate.

4. The antenna module in accordance with claim 3 and further comprising a crossed dipole GPS antenna disposed in a area of the substrate extending between a portion of the CB antenna loop and a portion of the AM/FM antenna loop.

5. The antenna module in accordance with claim 4 wherein the GPS antenna is connected to a fourth antenna feed line and wherein the module is installed under the dielectric roof of a motor vehicle having support posts at adjacent corners of the roof and wherein the first and second and third antenna feed lines are routed along one of the support posts to associated electronic equipment and the fourth antenna feed line is routed along the other of the support posts to associated electronic equipment.

6. The antenna module in accordance with claim 3 wherein the substrate comprises a flexible sheet of dielectric material.

7. The antenna module in accordance with claim 6 wherein the substrate is a sheet of fiberglass.

8. The antenna module in accordance with claim 6 wherein the substrate comprises a sheet of Kapton.

9. The antenna module in accordance with claim 6 wherein the flexible sheet has a thickness in the range of 0.010 to 0.050 inches.

10. The antenna module in accordance with claim 1 wherein the antenna module is installed under the dielectric roof of a vehicle and the dielectric roof has a thickness in the range of 0.075 to 0.400 inches.

11. The antenna module in accordance with claim 10 wherein the dielectric roof has a dielectric coefficient in the range of 2.0 to 5.0.

12. The antenna module in accordance with claim 1 wherein the conductor sections each comprise copper strip having a width in the range of 0.050 to 0.200 inches.

13. A planar antenna module for installation under a dielectric cover of a vehicle, comprising:

a dielectric substrate;

a mobile telephone antenna loop for transmission and reception of mobile cellular telephone signals and comprising a plurality of conductor sections on the substrate forming a substantially square loop having a perimeter of an electrical length approximately equal to two wavelengths of a signal in the frequency range of cellular telephone signals, the conductor sections at each corner of the square loop forming four separate loading capacitors, the conductor sections forming the capacitors adapted to be shortened to optimize the antenna effectiveness when installed in the proximity of dielectric covers of differing dimensions and dielectric characteristics;

the mobile telephone antenna loop comprising an array of four individual, substantially square antenna loops, each of the individual loops having sides of an electrical length equivalent to one quarter of one wavelength of the signal in the frequency range of cellular telephone signals.

14. The antenna module in accordance with claim 13 wherein the conductor sections each comprise a copper strip having a width in the range of 0.050 to 0.200 inches and wherein adjacent conductive strips are separated by a distance in the range of 0.100 to 0.400 inches.

15. The antenna module in accordance with claim 14 wherein the substrate comprises a flexible sheet of dielectric material having a thickness in the range of 0.010 to 0.050 inches.

16. The antenna module in accordance with claim 15 and installed under a dielectric roof of a motor vehicle having a thickness in the range of 0.075 to 0.400 and having a dielectric coefficient in range of 2.0 to 5.0.

17. The antenna module in accordance with claim 13 and wherein each of the individual loops has outer perimeter sections forming a part of the perimeter of the mobile telephone antenna loop and wherein current flow in adjacent outer perimeter sections of adjacent ones of the individual loops is in a the same direction.

18. An antenna module comprising:

a planar dielectric substrate adapted to be installed between the headliner of an automotive vehicle and a dielectric roof;

a pair of electrical conductors sections and a capacitor disposed on the substrate, each conductor section having one end connected to an antenna feedline and another end connected to one side of the capacitor and forming a substantially square antenna loop;

each side of the loop having an electrical length approximately equal to one wavelength at a frequency in the FM frequency range and the capacitor having a value of capacitance such that the capacitor presents an essentially short circuit in the FM frequency range and a substantial impedance in the AM frequency range, whereby the capacitor provides a substantially short circuit connection in the FM frequency range and a significant impedance value in the AM frequency range providing a loop antenna in the FM frequency range and a dipole antenna in the AM frequency range.

19. The antenna module in accordance with claim 18 and further comprising a mobile telephone antenna loop for transmission and reception of mobile cellular telephone signals and comprising a plurality of conductor sections on the substrate forming a substantially square loop having a perimeter of an electrical length approximately equal to two wavelengths of a signal in the frequency range of cellular telephone frequency signals.

20. The antenna module in accordance with claim 19 and further comprise a crossed dipole GPS antenna disposed in an area of the substrate extending between a portion of the CB antenna loop and a portion of the AM/FM antenna loop.

21. The antenna module in accordance with claim 20 and further comprising conductor sections disposed on the substrate forming a substantially square CB antenna loop surrounding the AM/FM antenna loop for transmission and reception in the CB frequency range.

* * * * *